US005480039A

United States Patent [19]

Merl

[11] Patent Number: 5,480,039

[45] Date of Patent: Jan. 2, 1996

[54] TWO BIN INVENTORY/FACING CONSTRUCTION FOR SIMILAR PRODUCTS WITH DIFFERENT PACKAGING OR DIFFERENT VERSIONS OF THE SAME SIZED AND SHAPED PRODUCT

[76] Inventor: Milton J. Merl, 50 Wilcox Rd., Stonington, Conn. 06830

[21] Appl. No.: 227,540

[22] Filed: Apr. 14, 1994

[51] Int. Cl.[6] ..... A47F 5/08

[52] U.S. Cl. ..... 211/88; 211/126; 211/170; 312/327

[58] Field of Search ..... 211/88, 75, 76, 211/84, 71, 187, 170, 126, 133, 106, 103, 99; D9/414, 420, 430, 431; 312/325, 327, 291

[56] References Cited

U.S. PATENT DOCUMENTS 2,677,483 5/1954 Shaw ..... 222/556
4,109,797 8/1978 Brunette ..... 211/126
4,368,937 1/1983 Palombo et al. ..... 312/325

*Primary Examiner*—Leslie A. Braun
*Assistant Examiner*—Anita M. King
*Attorney, Agent, or Firm*—Schweitzer Cornman & Gross

[57] ABSTRACT

A two bin inventory construction to accommodate similar products in different size packaging, or the same shape and size products which sell at different rates. The construction is self-contained and sits on a gondola base, a shelf spaced from the base, or via hooks directly to the gondola uprights, and includes a first lower bin and a second upper bin. The upper front portion of the lower bin is truncated to accommodate the smaller bin. The bins may each have a cradle configuration so that as goods are removed, remaining goods will fall to an accessible location. The smaller bin is pivotally mounted on the sides to the larger bin allowing the small bin to be swung to a lower position allowing greater access to the larger bin. When the smaller bin is in its normal position, its inventory is directly accessible, while the larger bin inventory is accessible by an opening formed between the smaller bin and a forward lip of the larger bin.

3 Claims, 8 Drawing Sheets

TWO BIN INVENTORY/FACING CONSTRUCTION FOR SIMILAR PRODUCTS WITH DIFFERENT PACKAGING OR DIFFERENT VERSIONS OF THE SAME SIZED AND SHAPED PRODUCT

The invention relates to gondola merchandising, and more particularly to an improved two bin construction for similar products having different packaging or different versions of the same sized and shaped product, for use in currently available gondolas.

SUMMARY OF THE INVENTION

The majority of inventory in today's stores are carried in gondola constructions. Gondola merchandising has changed little over the years. Generally there is a floor platform with a vertical upright pegboard. On the borders of the gondolas there are vertical weight-supporting uprights having a plurality of vertically aligned slots. The uprights, via the vertical slots, carry shelving and other inserts in or on which merchandise is placed. The pegboard carries some weight but it is minor in comparison to that carried by the uprights.

There is a constant demand for the self-service food and nonfood packaged goods industry retailers to increase their efficiency. Add to this the ever-expanding lines of products designed to attract more consumers, and which constantly fight for greater shelf space. This has all resulted in a greater segmentation of sales per individual retail unit of product.

Some products sell better than others. There is a tendency to under-inventory fast moving products, resulting in costly, shorter reorder cycles to maintain proper inventory. There is not enough gondola space available to keep top inventory items in open stock and the space has to be frequently serviced. At the same time slower moving items tend to stay on the shelves longer, occupying more space relative to their revenue contribution. All this activity has resulted in an extremely inefficient environment, both from labor, warehousing, and inventory management perspectives.

A particular problem involves products of a similar nature, but which are differently packaged. For example, pasta may come in straight spaghetti strings packed in nice neat rectangular packages of generally square cross section. Or, pasta can be in the shape of macaroni elbows which tend to be fluffy or expanded larger packaging, coming either in a larger box or in a bag. Other examples of such types goods are candy and beans. Often times these products, while sometimes moving at different sales rates, often times move at the same sales velocity.

Another problem involves different versions of the same sized and shaped product, where one version sells at a faster rate. An example would be pudding. The shape and size of the pudding packaging is the same, but chocolate pudding sells at a faster rate than vanilla pudding.

The current gondola merchandising system is outdated in its ability to inventory or display products in volume that match their turns. Accordingly, key sellers in the category tend to be depleted while slow sellers tend to be over inventoried. The current "solution" necessitates frequent ordering and stocking a very costly solution. Typically a 40% increase in financing is required to carry double the amount of inventory of fast moving products upon which reorder cycles are determined.

As a result there is a need to organize and lay our or "planogram" gondola shelf facings, while providing easy and proximate access to inventory based upon how the individual products sell. This should result in creating a method of controlling inventory regardless of the product movement. While it is possible to compensate for key sellers providing more selling volume, in reality, most stores are not large enough to accept the room necessary to display the appropriate facings of fast movers to, in effect, balance out different product category. There is just not enough space in the average store to display or stock everything properly.

An object of the present invention is to develop a two bin construction for similar products with different packaging or different versions of the same sized and shaped product.

Another object of the present invention is to provide a construction of the character desires that divides the gondola into two cubic volumes, one to carry smaller more densely packaged products, such as spaghetti or a slower selling version of a product, and the other to carry larger or bulky shaped packaged items, such as macaroni or a faster selling version of a product.

Still yet another object of the present invention is to provide an improved construction which provides sufficient bin display to satisfying planogrammed facings.

Still yet a further object of the present invention is to provide a construction which can be secured to the standard vertical uprights of a store gondola.

Still yet another object of the present invention is to provide a construction which will have equal facing areas with associated disproportionate inventory volumes.

Still yet a further object of the present invention is to provide a construction which divides the typical shelving area into two cubic areas, one to accommodate smaller package products or slower selling versions of a product, and the other to accommodate larger or bulky products or faster selling versions of a product.

Still yet a further feature of the present invention is to provide a two bin construction in which the smaller bin will carry densely packed versions of a product and the large bin will carry awkwardly packed versions of similar product, for example the top bin could carry packages of straight spaghetti while the bottom bins could carry bags of elbow macaroni or other oddly shaped products.

Yet a further feature of the present invention is to provide a two bin construction in which the smaller bin will carry a slower selling version of a particular sized and shaped product, and the larger bin will carry a faster selling version of the same product.

Still yet a further object of the present invention is to element gaps in selling areas, or in other words, to eliminate visual out-of-stock product.

Another object of the present invention is to provide a construction which will improve the pack-out, namely, providing a means for putting for more inventory in the same cubic volume, then done previously.

Still another objection of the present invention is to provide a device of the character described with means to pivot the front bin to a position allowing easy access to the back bin.

Yet another object of the present invention is to provide a two bin construction which will allow a balanced inventory, namely for having similar number of units of the more densely smaller pack products in the smaller bin and the same or similar numbers of the larger products in the larger bin.

The invention consists of a two bins generally of different sizes, a lower or larger or back bin in which is nested a smaller or upper or front bin, the bins being pivotally connected. The bins are designed to be placed on the base or shelf of a typical gondola construction. As an alternative, the back of the bin can have hooks to engage the vertical uprights of the gondola. The bins are designed so that there are sloping lower rear and front walls so that goods to an accessible location in the inventory bin. The upper front portion of the layer bin is cut away and receives the smaller bin. The smaller bin is received within the cut out portion of the larger bulk bin so that when it is in the upright, closed position, it basically follows the otherwise normal dimensions of the lower bin. The body of the smaller bin and the larger bin form a facing opening. The front bin is connected by pivot arms to the back bin for circular movement away and down from the larger opening of the larger bin.

The smaller bin may carry either predetermined numbers of densely packed product facings, such as spaghetti. The lower bin may carry a similar product, such as bags of elbow macaroni. Alternatively, the smaller bin may carry a slower moving version of a specific sized and shaped product. The lower bin may carry a faster selling version of the same sized and shaped product. But products are accessible from the facing openings. However, the inventory volumes are clearly disproportionate. Because of the increased lower bin volume behind and in back of the smaller bin, as products are sold and taken from the back bin, inventory in the back moves forward and takes its position towards the front. The bins can also be L-shaped.

BRIEF DESCRIPTION OF THE DRAWINGS

Other objects and advantages of the present invention will become apparent when taken in relation with the accompanying drawings in which.

DETAILED DESCRIPTION OF THE DRAWINGS

Figure 1:
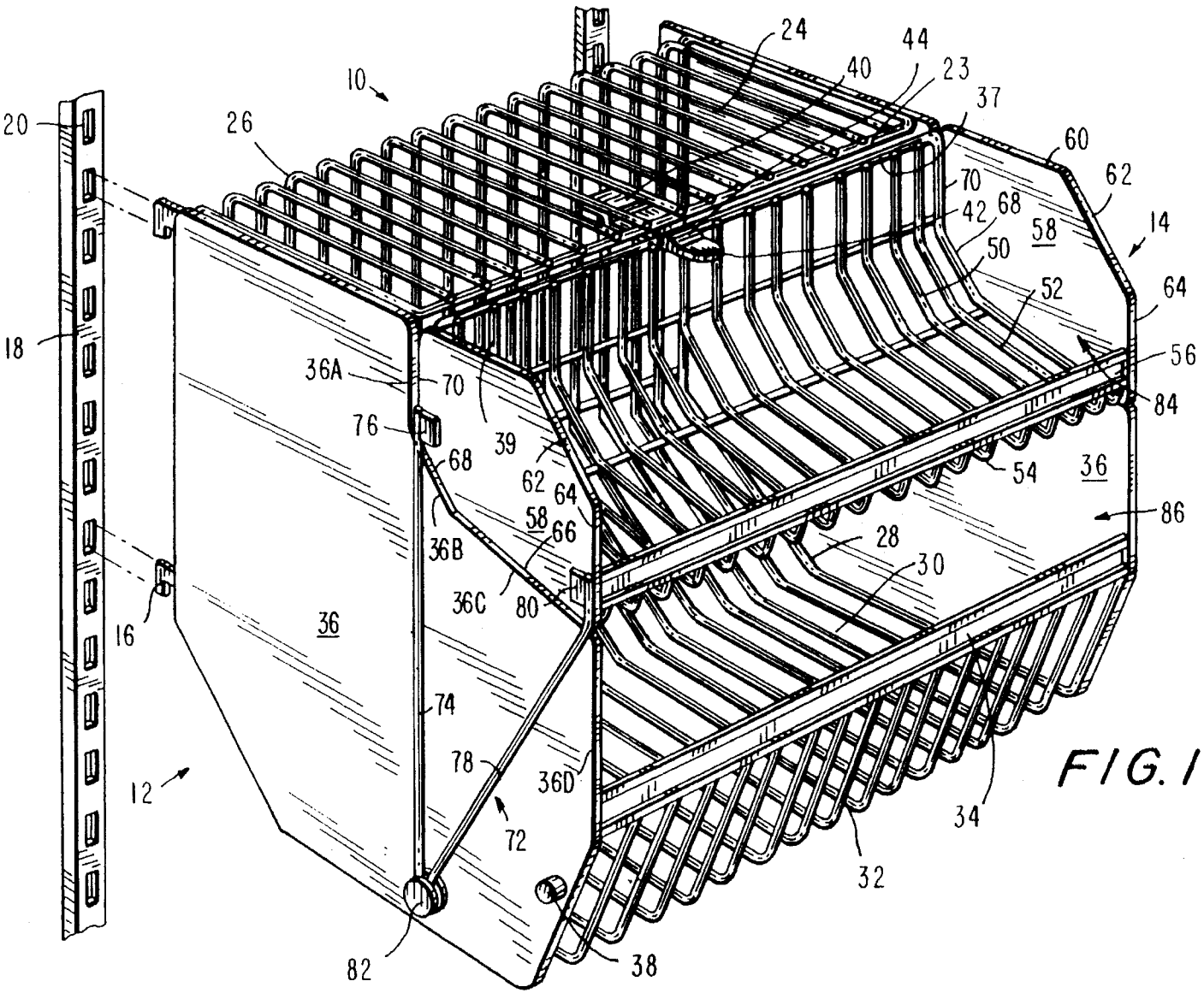
FIG. 1 is an exploded front perspective view showing the two bins about to be connected to the vertical uprights of a typical gondola, the smaller bin being secured to the larger bin.

Turning in detail to the drawings and more particularly to FIG. 1 there is shown an alternate embodiment of the invention, namely two bin inventory construction unit 10 comprising a lower or larger or back bin 12, an upper or smaller or front bin 14, the unit being secured by hooks 16 to gondola vertical uprights 18 in slots 20.

More specifically, the larger bin (and the smaller bin) may be made of parallel wire grating, although any construction to provide the general outlines of walls is acceptable. In cross section the bin is somewhat rectangular in shape, but with the rear lower and front upper walls being cut off.

More specifically, the larger bin is defined by an upper lip 23 which is the leading top edge of the bin. The grating then forms, in essence, a top wall 24, an upper rear wall 26, and a lower inwardly diagonally directed rear wall 28. It is further defined by bottom 30, and a lower upwardly diagonally directed front wall 32, terminating in a lower forward lip 34. This unit is encased by sidewalls 36. The sidewalls follow the dimensions of the top, rear, bottom and front walls of the bin. In additional the sidewalls are partially cut away at the upper front portion and define a downwardly extending upper front wall 36A, a diagonally forwardly directed front wall 36B, a further diagonally directed but more horizontal front wall 36C, and terminate in vertically downwardly directed front wall 36D. Placed proximately medially on the lower forward edge of the sidewall is a stop 38. Positioned essentially medially on the top wall and extending forwardly of the lip 23 is a snap latch 40 having a finger 42 with a stop shoulder 44.

The small bin is defined by an upper rear lip 37, upper rear wall 39, a lower diagonally inwardly directed rear 50, a bottom wall 52, a lower upwardly diagonally directed front wall 54, and terminates in a lower forward front lip 56. The small bin is also enclosed by sidewalls 58 following the contours of the rear, bottom and front walls. In addition it is defined by a forwardly extending top wall 60, a diagonally downwardly extending upper front wall 62 terminating in a vertically downwardly extending front wall 64. Extending rearwardly and diagonally upwardly from the bottom of front wall 64 is a bottom wall 66 and then hence connected rearwardly more angularly upwardly directed rear wall 68 terminating in vertically upwardly directed rear wall 70.

The walls 36A–70; 36B–68; and 36C–66 abut each other so that the smaller bin nests in the larger bin.

The two bins are connected via a pivot arm assembly 72 comprising a rear vertical pivot arm 74, secured to a rear portion of the small bin at 76. The forward diagonal pivot arm 78 is secured at 80 to the smaller bin, both arms being connected to a pivot member 82.

The open portion 84 of the front bin and the open portion 86 of the back bin form substantially equal facing areas.

Figure 4:
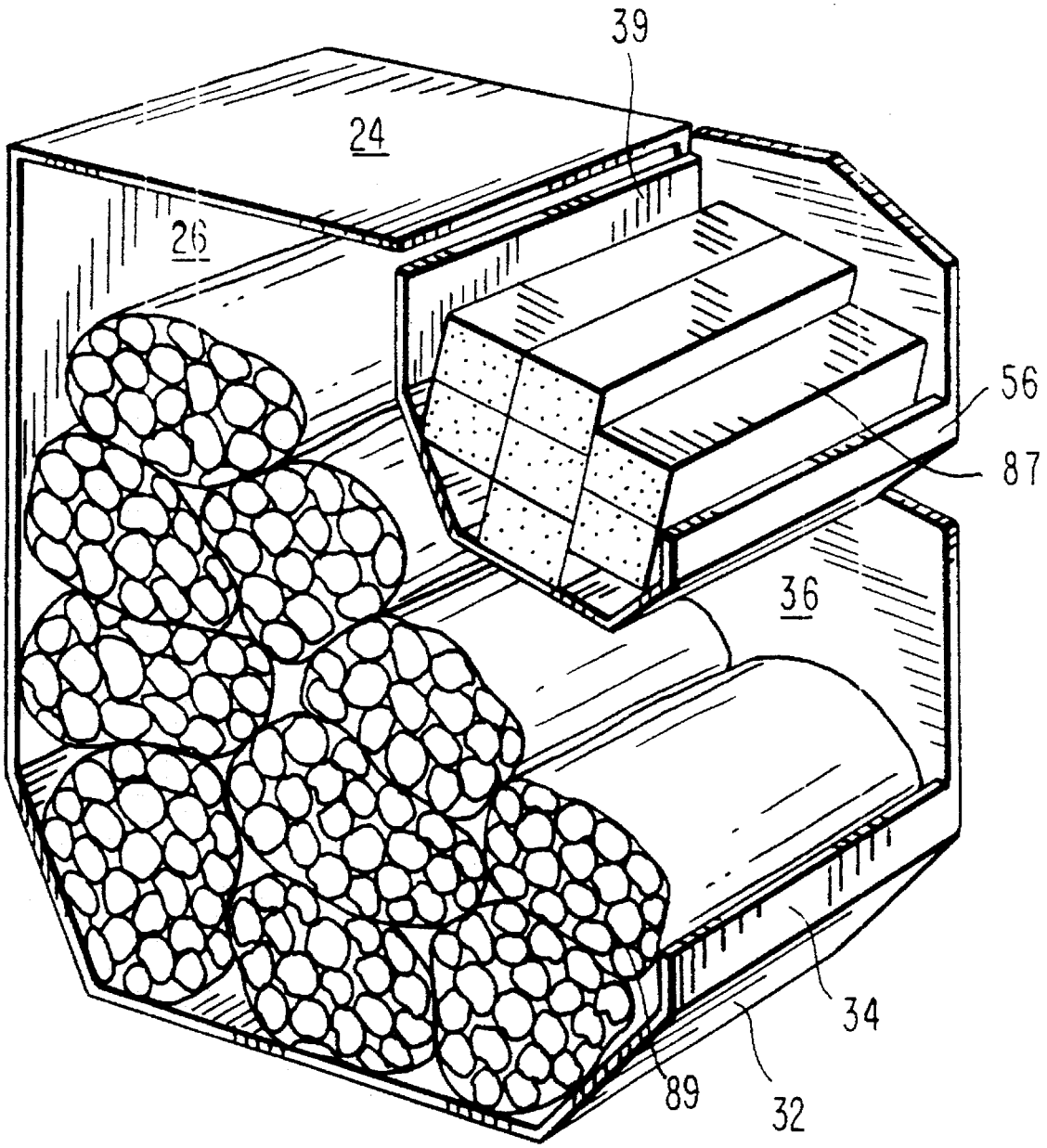
FIG. 4 is a cut away view similar to FIG. 1, and showing densely packed product in the upper bin and more loosely packed bulkier product in the lower bin.
Figure 5:
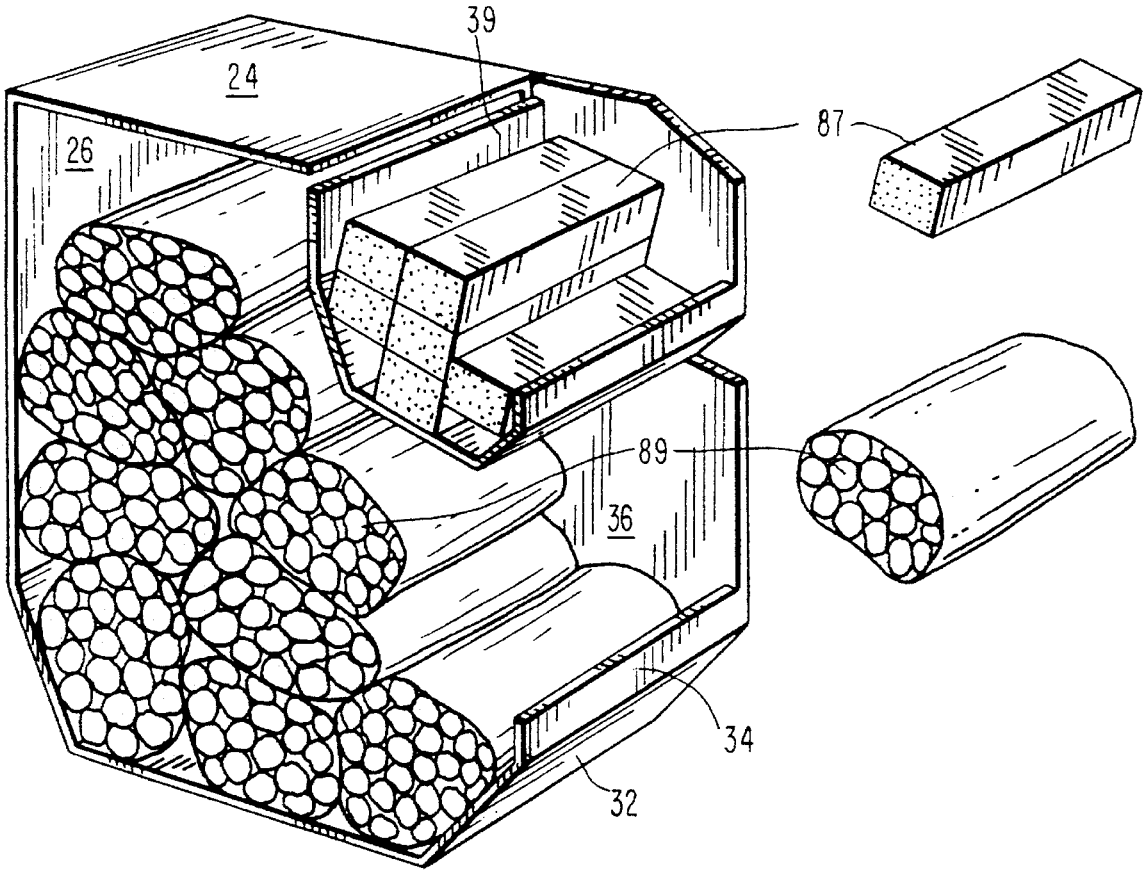
FIG. 5. is a view similar to FIG. 2 showing how product is removed from the bins.

As can best be seen in FIG. 4, when considering different sized product of the same or similar sales velocity smaller packages of spaghetti 87 can be stacked within the upper bin. Larger, bulkier, or fluffy packages of macaroni pasta 89 can be stacked in the larger bin. Merchandise moves out of the bin at shown in FIG. 5. As the merchandise moves out of the larger bin, the remaining inventory which is stacked in the back, by gravity feet simply falls down and moves forward, helped along by the lower diagonal rear wall 28. It is obvious that more inventory of these products can be placed within the construction disclosed in this invention and could normally be placed on shelving with an extended gondola. Furthermore, it is obvious that the inventory is fairly well balanced even though the volume size of the products are different. Since the products tend to move at the same sales velocity, inventory restocking can be done at the same time. Because the larger, bulkier material is generally covered up by and stocked behind the smaller bin, it is possible to have additional facings of a different product. Accordingly, the stocker can improve the planograms. The pivotal arms are parallel to each other and are vertically positioned in their normal resting position with respect to the bottom wall of the bin. The pivot points are positioned so that during the circular travel of the arms, they maintain the smaller or front bin at all times in the same planar position with respect to the base of the bin as it is in its resting position.

Finally, because of the additional inventory location and natural movement of the bulkier product, visual out-up-stock gaps on the gondola are eliminated.

Figure 2:
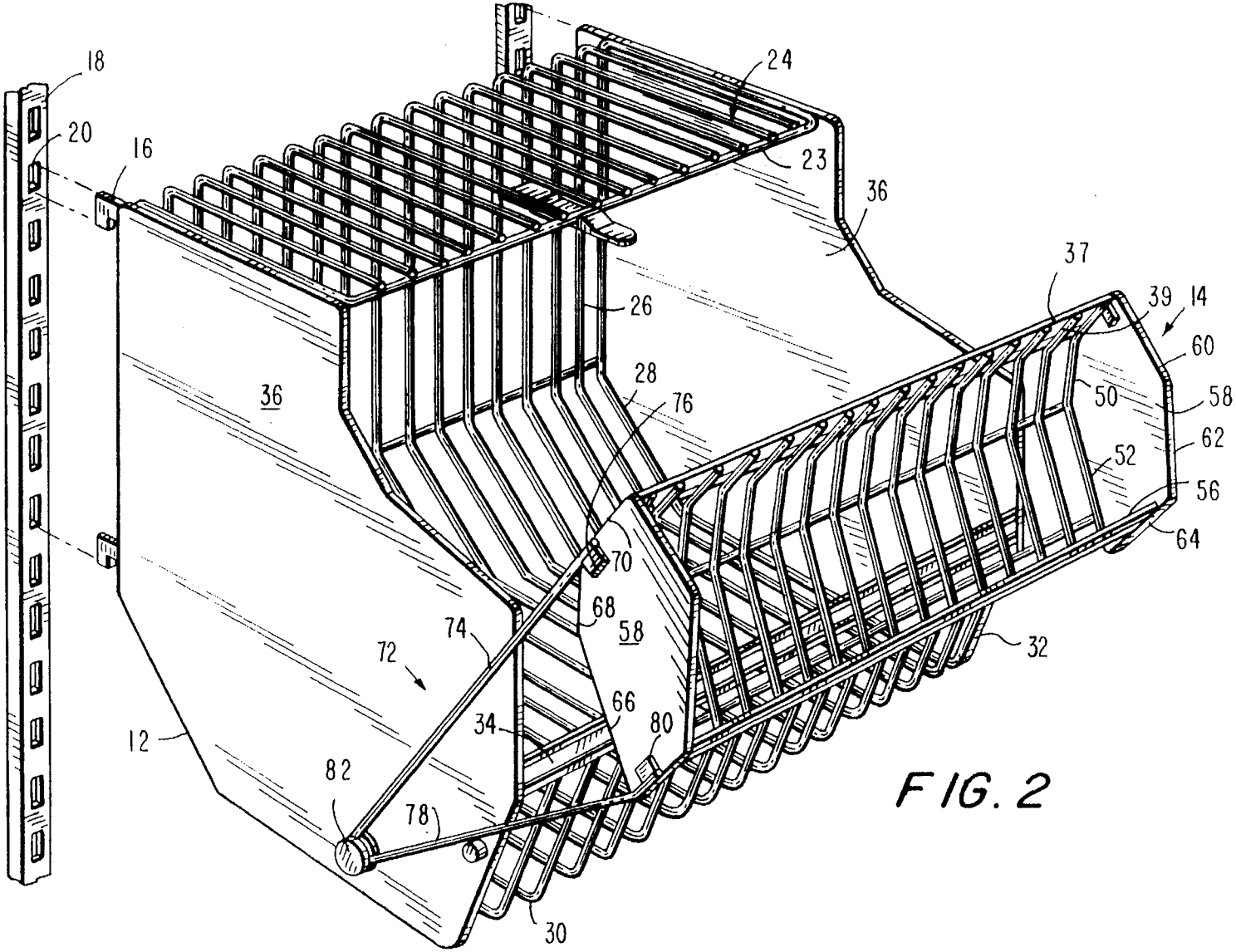
FIG. 2 is a view similar to FIG. 1, but showing the smaller bin detached from the larger bin and moving circularly away from and down of the larger bin, allowing access to the larger bin.
Figure 3:
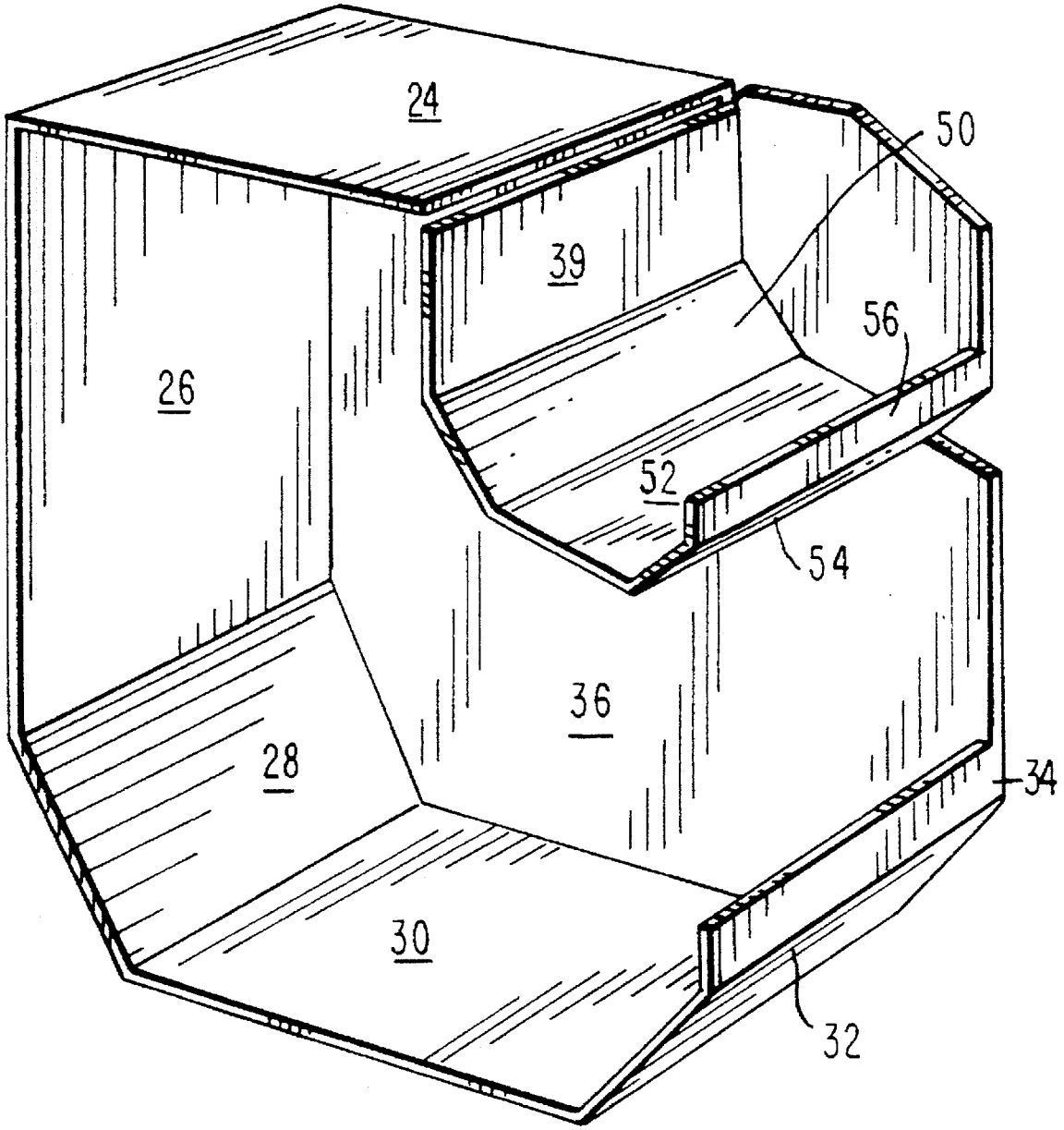
FIG. 3 is a cut away view similar to FIG. 1, but showing the grating as solid walls.
Figure 6:
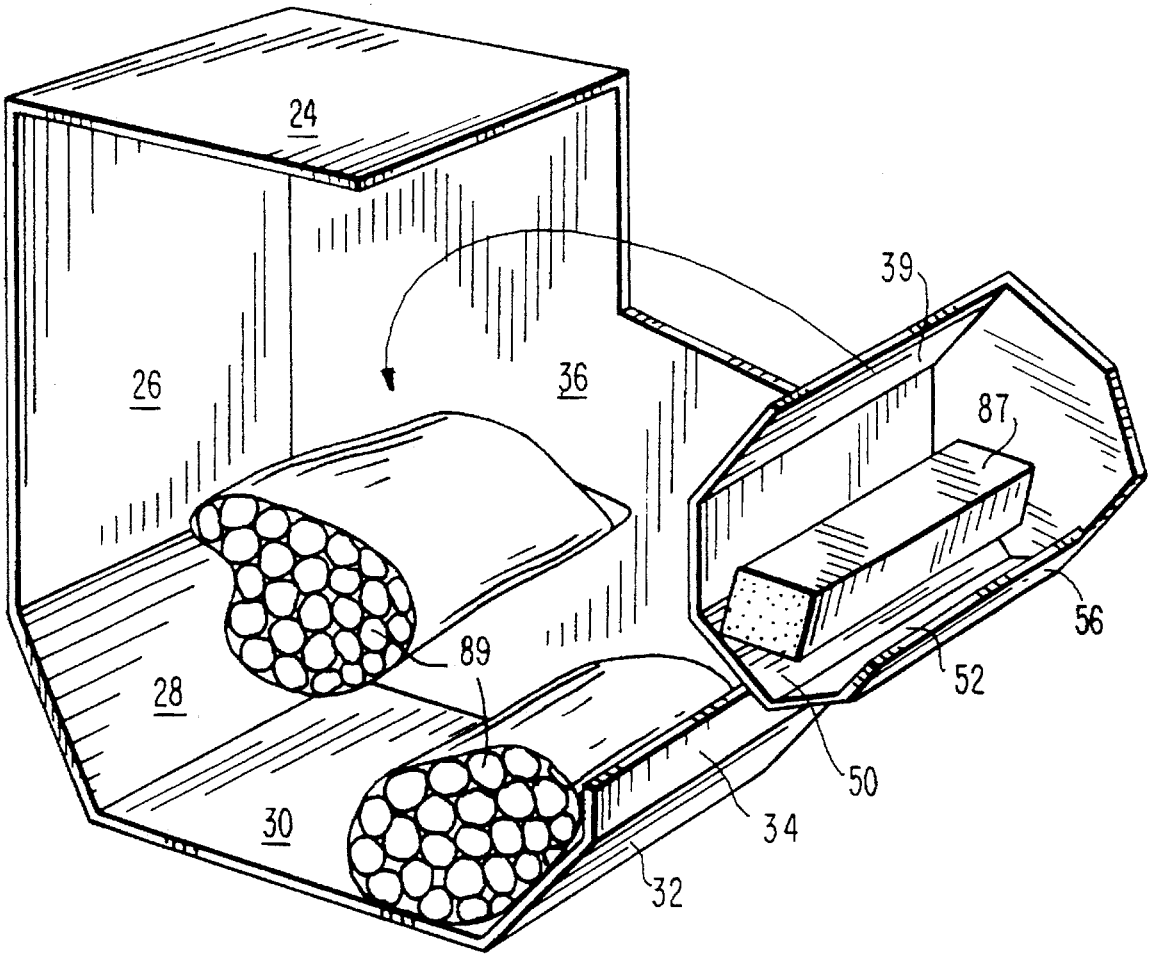
FIG. 6 is a view similar to FIG. 3 and showing the upper bin moved forward to allow egress to the larger bin for restacking of inventory.

When inventory is low, as seen in FIG. 6, the clerk releases the latch mechanism by depressing the finger 42 and allowing the shoulder stop 44 to go below the lip 36 of the smaller bin. Then the unit is pivoted in a circular motion via the arm construction 72 about pivot member 82 forwardly and downwardly until arms 78 meets stop 38 (FIG. 2). In its open state, merchandise is filled up in the larger bin going not only to the rear but behind the back of the smaller bin when it is in its close position. The smaller bin is then rotated upwardly and rearwardly and once again resumes the position shown in FIG. 1. It is then restocked.

Figure 7:
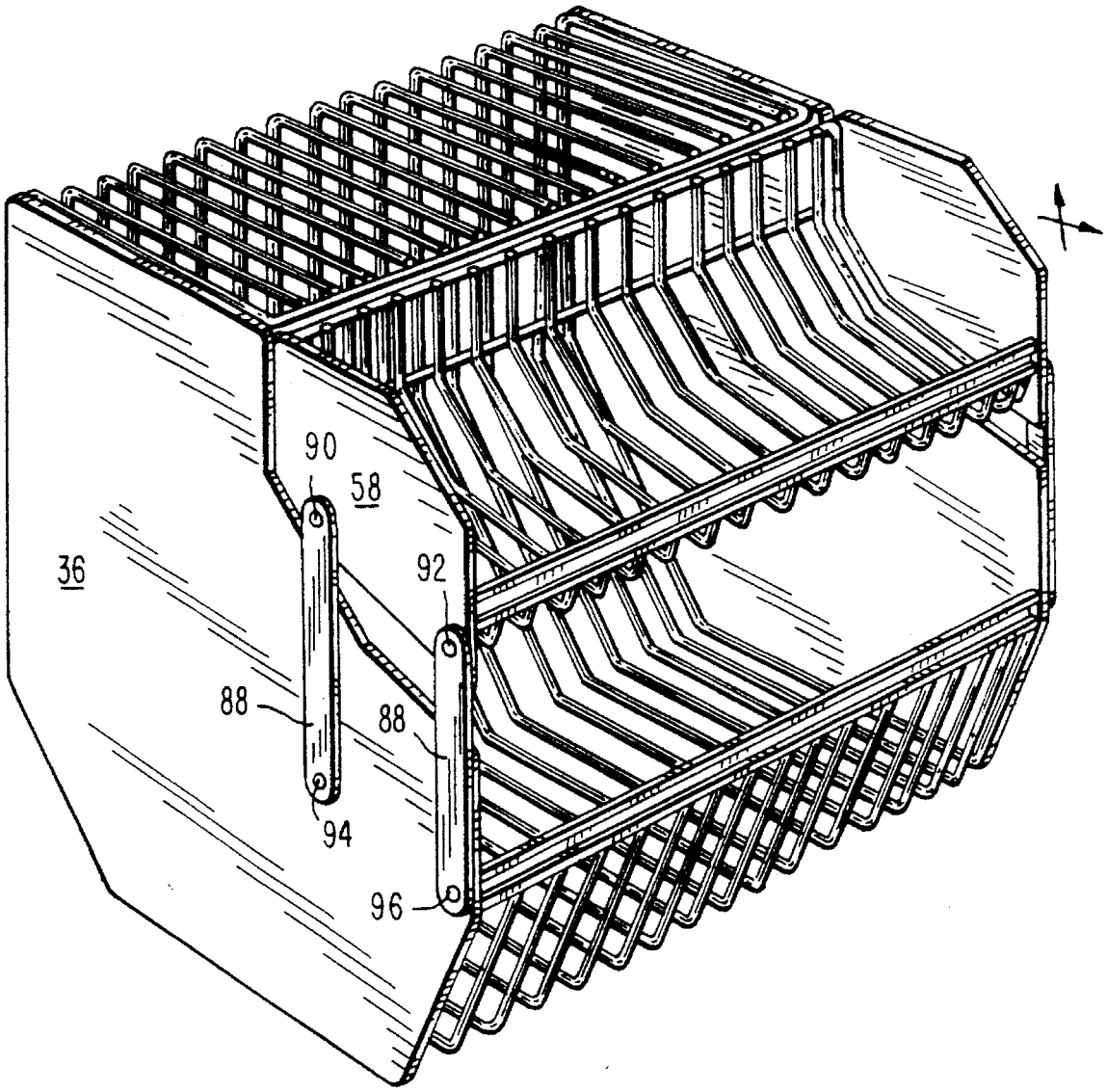
FIG. 7 is a view similar to FIG. 1, showing the preferred embodiment of the invention with parallel pivot arms.
Figure 8:
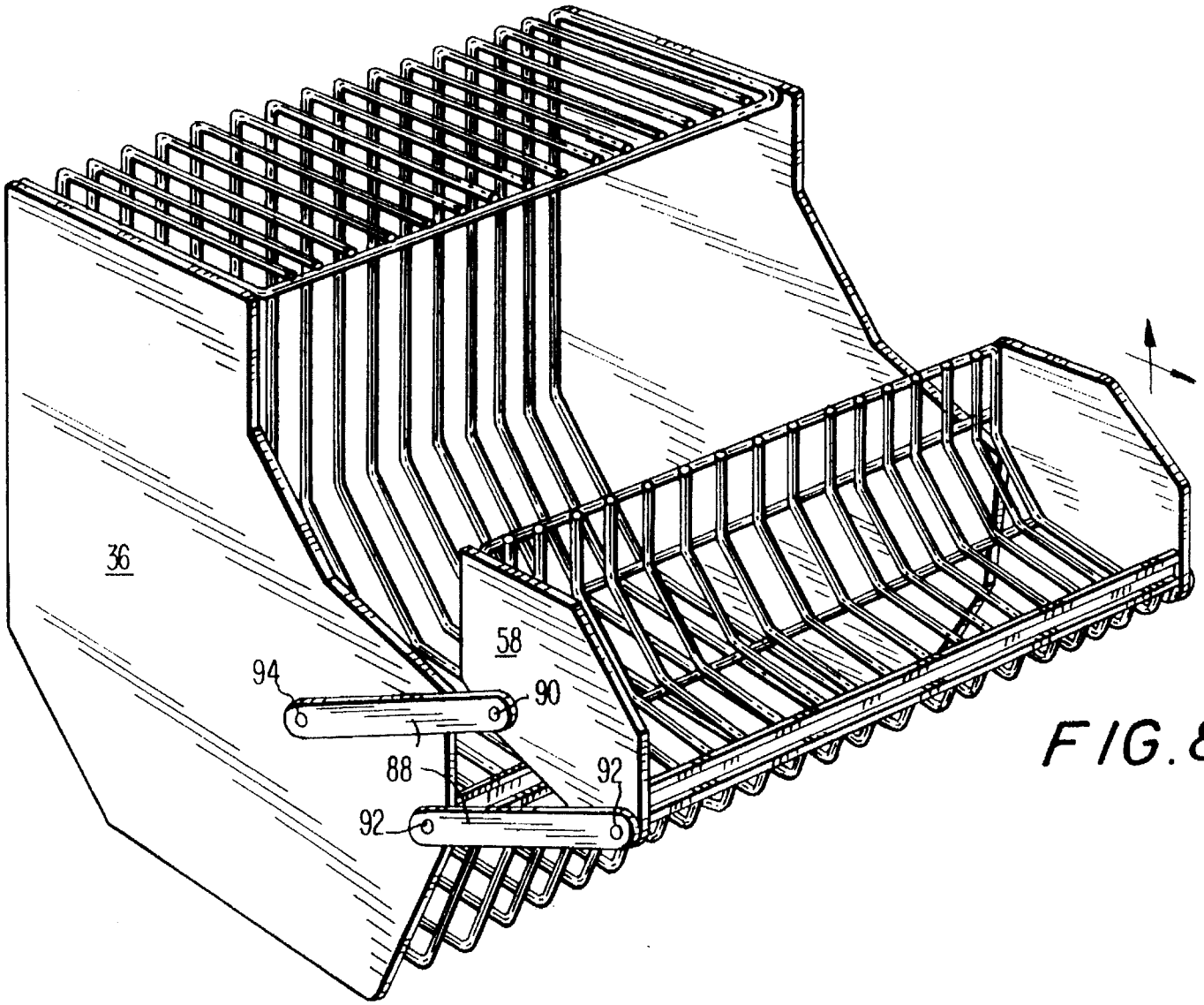
FIG. 8 is a view similar to FIG. 2.

Turning to FIGS. 7 and 8, there is shown a preferred embodiment of the invention. The front bin is connected to the back pin by means of two parallel pivot arms 88, pivotally secured to the front or upper bin as at 90, 92 and the lower bin as at 94, 96. The arms are perpendicular to the bottom wall when the front bin is in its upper position. The reason for this being the preferred embodiment, is seen in FIG. 7. When the bin is moved in the circular downward direction, because of the arm placement in the well-known manner, it remains in a horizontal position or in the same position relative to the ground as in FIG. 6. Therefore, if there is any inventory in the bin, it will not move forward and fall out of the bin.

It is also possible that the bin construction is L-shaped at the lower walls. That is it does not have a diagonally sloping front and rear lower walls. The essence of the invention is the ability to prevent equal facings for different versions of the same sized and shaped products, which sell at different sales velocities, related products of different sizes and which sell at the same sales velocity. It would also be possible to sell unrelated products of different sizes and different sales velocities, but this is not commonly done.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A two bin inventory/facing construction for similar products with different packaging or different versions of the same sized and shaped product for increasing the efficiency of a gondola merchandising system having a base, vertical uprights secured to the base, and space shelving along the vertical upright and spaced from the base, said two bin inventory/facing construction comprising (a) a back bin adapted to be horizontally supported by the vertical uprights;

(b) the back bin having a bottom wall, diagonally sloping rear and front walls, and sidewalls, forming a cradle-type compartment;

(c) a front bin having a bottom wall, rear and front sloping walls and sidewalls, forming a smaller cradle, said front bin being received proximate to an upper forward portion of the back bin and being positioned in an opening in the back bin; and (d) means pivotally connecting the front bin to said back bin, allowing movement of said front bin from an upper position resting proximate the back bin to a lower position spaced away from the back bin allowing access to said back bin.

2. The two bin inventory/facing construction according to claim 1, further characterized by the back bin being larger than the front bin.

3. The two bin inventory/facing construction according to claim 2, further characterized by (a) the pivot means comprising two spaced parallel pivot arms which are normally in a vertical position; and (b) means to pivotally secure said pivot arms in position whereby the position of said front bin in the lower extended position is in the same plane as that in its upper resting position.

* * * * *